US012066015B2

(12) United States Patent
Suh et al.

(10) Patent No.: US 12,066,015 B2
(45) Date of Patent: Aug. 20, 2024

(54) MECHANISM FOR ELECTRONIC ADJUSTMENT OF FLOWS IN FIXED DISPLACEMENT PUMP

(71) Applicant: FLUID METERING, INC., Syosset, NY (US)

(72) Inventors: Francis Dongil Suh, Whitestone, NY (US); Joseph Ervin Middleton, Hicksville, NY (US); David Lionel Rawlings, Sound Beach, NY (US)

(73) Assignee: FLUID METERING, INC., Syosset, NY (US)

( * ) Notice: Subject to any disclaimer, the term of this patent is extended or adjusted under 35 U.S.C. 154(b) by 308 days.

(21) Appl. No.: 17/603,617

(22) PCT Filed: Jul. 30, 2020

(86) PCT No.: PCT/US2020/044252
§ 371 (c)(1),
(2) Date: Oct. 14, 2021

(87) PCT Pub. No.: WO2021/022034
PCT Pub. Date: Feb. 4, 2021

(65) Prior Publication Data

US 2022/0213884 A1 Jul. 7, 2022

Related U.S. Application Data

(60) Provisional application No. 62/881,086, filed on Jul. 31, 2019.

(51) Int. Cl.
*F04B 1/295* (2020.01)
*F04B 7/06* (2006.01)
(Continued)

(52) U.S. Cl.
CPC ..... *F04B 1/295* (2013.01); *F04B 7/06* (2013.01); *F04B 17/03* (2013.01); *F04B 13/00* (2013.01); *F04B 19/22* (2013.01); *F04B 49/125* (2013.01)

(58) Field of Classification Search
CPC .. F04B 1/295; F04B 7/06; F04B 17/03; F04B 13/00; F04B 19/22; F04B 49/123; F04B 49/125; F04B 2203/04
See application file for complete search history.

(56) References Cited

U.S. PATENT DOCUMENTS 3,382,812 A 5/1968 Smith
5,246,354 A * 9/1993 Pardinas ..... F04B 7/06 92/13
(Continued)

OTHER PUBLICATIONS

Collinsdictionary.com; FLAT definition in American English _ Collins English Dictionary pdf from collinsdictionary.com/us/dictionary/english/flat (Year: 2024).*

*Primary Examiner* — Charles G Freay
*Assistant Examiner* — David N Brandt
(74) *Attorney, Agent, or Firm* — Hoffmann & Baron, LLP

(57) ABSTRACT

An electronic angle adjustment mechanism for a pump and a motor generally includes a base and a linear actuator. The base has an upper portion mounted to a motor, a lower portion mounted to a pump, and a hinge for pivotably moving the upper base portion in relation to the lower base portion. The linear actuator is mounted to on an attachment plate that also attaches the motor to the upper base portion. The linear actuator can drive a flexible member or connect to a gear wheel or worm screw to pivot about the hinge and change an angle between the upper and lower base portions.

10 Claims, 8 Drawing Sheets

(51) Int. Cl.

| | |
|---|---|
| ***F04B 13/00*** | (2006.01) |
| ***F04B 17/03*** | (2006.01) |
| ***F04B 19/22*** | (2006.01) |
| ***F04B 49/12*** | (2006.01) |

(56) References Cited

U.S. PATENT DOCUMENTS

| | | | | |
|---|---|---|---|---|
| 7,708,535 | B2 * | 5/2010 | Peeler | G01N 35/1095 417/500 |
| 2002/0057970 | A1 * | 5/2002 | Amsler | G01F 11/22 417/500 |
| 2005/0013708 | A1 * | 1/2005 | Peeler | F04B 49/12 417/415 |
| 2014/0142507 | A1 * | 5/2014 | Armes | A61M 5/20 604/112 |
| 2016/0245275 | A1 | 8/2016 | Rawlings | |
| 2018/0087497 | A1 | 3/2018 | Beauman et al. | |

* cited by examiner

MECHANISM FOR ELECTRONIC ADJUSTMENT OF FLOWS IN FIXED DISPLACEMENT PUMP

CROSS-REFERENCE TO RELATED APPLICATIONS

This application is a National Phase application of International Application No. PCT/US20/44252, filed Jul. 30, 2020, which claims priority from U.S. provisional patent application Ser. No. 62/881,086, filed Jul. 31, 2019, the disclosures of which are incorporated herein in their entirety for all purposes.

FIELD OF INVENTION

The present invention relates to pumps used to dispense small amounts of fluids at accurate flow rates. In particular, the invention relates to a mechanism that electronically adjusts the dispensing of fluids from a pump at low flow rates.

BACKGROUND

A family of valve-less pumps, which have at their heart special mounting means, commonly referred to as a base, interposed between a drive motor and a pump head, is known in the art. These bases are typically injection molded plastic and incorporate a living hinge separating an upper base portion from a lower base portion. The upper base portion can be tilted with respect to the lower base portion by flexure of the living hinge. The relative angle between the upper and lower base portions establishes the pump output volume per revolution. This entire mechanism was previously described in commonly owned U.S. Pat. Nos. 5,020,980 and 4,941,809, and U.S. Patent Application Publication No. 2016/0245275, each of which is incorporated herein in its entirety.

Conventionally, the method for adjusting and setting the angle is accomplished by means of an adjusting screw engaging with pivot pins in the two portions of the base, which are positioned on the opposite side of the central axis of the base. Certain applications require pumps with the same target output per revolution. This was accomplished by substituting fixed linkage means for the adjustable screw and pivot pins. The fixed links are injection molded from plastic resin and the tooling used to mold these links allows for different lengths to be produced such that different target pump displacements can be routinely produced. An eccentric bushing providing a combination of the benefits of an adjusting screw and a fixed link is disclosed in commonly owned U.S. Patent Application Publication No. 2016/0245275.

These traditional methods for changing the output volume per revolution by adjusting the angle between the upper base portion and lower base portion have all required manual adjustment. This has generally made conventional pumps only convenient for use at a single output volume per revolution.

However, there are applications where it would be beneficial to be able to electronically adjust the output volume per revolution. This would allow an electronic system to adjust these pumps without manual intervention. U.S. Pat. No. 7,708,535 discloses a method for electronic adjustment of the angle of the base. However, the device disclosed in this patent uses rigid members to translate linear motion to angular motion. This leads to varying angular movement relative to linear movement, which leads to a complex relationship when defining the linear motion required to adjust the angle between the two portions of the base.

Moreover, due to the nature of the mechanism linking the piston to the motor shaft, the output volume is not a constant flow rate when the motor is rotated at a constant speed. Instead, the flow rate through the pump head is sinusoidal with the dispense to the outlet port being the positive portion of the sine wave and the aspirate from the inlet port being the negative portion of the sine wave.

However, there are applications where the sinusoidal nature of the dispense is not acceptable and a constant flow rate is desired. In these cases, a traditional syringe pump is generally favored for the constant flow rate it can easily provide.

There are also applications where a pump is used to dispense a small volume. This sometimes means that it takes a significant length of time to prime the line from the fluid source to the pump and to the dispense tip.

In certain cases, a pump is used to aspirate a fluid into a probe tip and dispense portions of the aspirated fluid into other receptacles. A fixed displacement pump can be used for these cases by rotating the motor in the reverse direction to aspirate. However, due to the design of the fixed displacement pump, the aspirate volume may not be the same as the calibrated dispense volume.

Another drawback with traditional syringe pumps is that a linear actuator is used to move the plunger to pull fluid into and push fluid out of a barrel. The accuracy of a syringe pump is generally tied to the size of the syringe barrel. The larger a syringe barrel, the lower its accuracy and precision. In order to have high accuracy at smaller volume dispenses or aspirates, a smaller barrel must be used. This is due to the smallest reliable increment of linear distance travelled in a syringe pump being related to a volume of fluid being moved. As the barrel size grows, this increment of linear distance relates to a larger volume of fluid being moved.

Still another drawback with pumps of the prior art relates to the need for priming such pumps. In order to decrease priming time and limit use of the syringe pump as much as possible, some systems include a priming pump with a syringe pump. The priming pump fills the lines quicker than the syringe pump and also limits the use of the syringe pump in order to increase the time between required maintenance of the syringe pump.

Accordingly, it would be desirable to provide a means for remote adjustment of output volume per revolution of a fixed displacement pump. It would be further desirable to provide a mechanism capable of overcoming the restrictions of sinusoidal output of a fixed displacement pump and also capable of varying output volume per revolution. It would also be desirable to overcome issues of varying aspirate volumes relative to dispense volumes in a fixed displacement pump and to overcome accuracy restrictions related to syringe pump barrel sizes, while also incorporating priming capabilities.

SUMMARY

In a first embodiment of the present invention, an electronic angle adjustment mechanism for a pump and a motor is provided. The mechanism generally includes a base, a linear actuator and a flexible member. The base has a motor flange for mounting a motor, a pump flange opposite the motor flange for mounting a pump and a hinge or hinge assembly disposed between the motor flange and the pump flange. The pump flange can be integrally formed as part of a collar that is attached to the pump housing or can be formed as part of the pump housing. The linear actuator is mounted to one of the motor flange or the pump flange of the base and the flexible member has a proximal end attached to the linear actuator and a distal end opposite the proximal end connected to the other of the motor flange or the pump flange of the base. When actuated, the linear actuator drives the flexible member in a curved path causing the motor flange and the pump flange to pivot with respect to each other about the hinge, thereby changing an angle between the motor flange and the pump flange.

The electronic angle adjustment mechanism can also include a cam block mounted to one of the motor flange or the pump flange, wherein the cam block has a curved support surface for guiding the flexible member in the curved path. An attachment plate can be mounted between the motor flange and the motor. The attachment plate extends outwardly from the motor parallel to the face of the motor flange and is sized to accommodate the mounting of the electronic adjustment mechanism. Preferably, the attachment plate is integrally formed as part of the motor flange. The curved support surface has a radius of curvature about a pivot point of the base hinge defined by the distance from the pivot point to the connection point of the flexible member with the other of the motor flange or the pump flange.

In the first embodiment, the angle adjustment mechanism preferably includes a roller bearing adjacent the cam block. The roller bearing presses the flexible member against the curved surface of the cam block.

The flexible member may comprise a spring steel material such that the flexible member is bendable for transitioning a linear motion of the linear actuator to a pivoting motion of the motor flange and the pump flange with respect to one another.

In another aspect of the first embodiment of the present invention, a motor and pump assembly is provided. The motor and pump assembly generally includes a base, a motor, a pump, a linear actuator and a flexible member. The base includes a motor flange, a pump flange opposite the motor flange and a hinge disposed between the motor flange and the pump flange. The motor is mounted to the motor flange of the base, and has a shaft rotatable about a rotation axis. The pump is mounted to the pump flange of the base, and has a piston rotatable about a rotation axis and linearly translatable along the rotation axis, wherein the pump piston is coupled to the motor shaft. The linear actuator is mounted to one of the motor flange or the pump flange of the base, and the flexible member has a proximal end attached to the linear actuator and a distal end opposite the proximal end connected to the other of the motor flange or the pump flange of the base. When actuated, the linear actuator drives the flexible member in a curved path causing the motor flange and the pump flange to pivot with respect to each other about the hinge thereby changing an angle between the rotation axis of the motor shaft and the rotation axis of the pump piston about the hinge.

In one aspect of the present invention, the linear actuator includes a drive rod movable along a linear axis, and a drive rod coupler attached to a distal end of the drive rod, wherein the flexible member is attached to the drive rod coupler. In this aspect, the linear actuator is preferably mounted to the motor flange and the drive rod extends parallel with the rotation axis of the motor shaft. The linear actuator can be a DC, AC, or a brushless DC motor, more preferably a stepper motor.

In another aspect of the present invention, a method for adjusting the angular orientation between a motor shaft of a motor and a pump piston of a pump is provided. The method generally includes providing a base between the motor and the pump, wherein the base includes a motor flange for mounting the motor, a pump flange opposite the motor flange for mounting the pump and a hinge assembly disposed between the motor flange and the pump flange, and driving a flexible member in a curved path against one of the motor flange or the pump flange with a linear actuator mounted to the other of the motor flange or the pump flange, thereby changing an angle between the motor shaft and the pump piston about the hinge assembly.

In a second embodiment of the electronic adjustment mechanism, the pump and motor are the same as in the first embodiment described above. The base is formed by an upper base portion and a lower base portion that are pivotably connected by a hinge or hinge assembly but a different electronic adjustment mechanism is used. In the second embodiment, the attachment plate extends outwardly from the motor and a sidewall extends downwardly. An electric motor, preferably a DC, AC, or brushless DC motor, more preferably a stepper motor, is attached to the outside of the sidewall and the motor shaft passes through the sidewall. A gear wheel with a plurality of teeth is attached to the distal end of the motor shaft. A collar is attached to the lower base portion. The collar fits around the outside of the lower base portion and is attached by a clamp, screws, bolts, an adhesive, or other known fastening devices. The collar can also be integrally formed as part of the lower base portion or pump housing and it can also have a flange extending outwardly from at least part of the exterior surface. On one side of the collar, the lower base portion is attached to the upper base portion by the hinge. Opposite the hinge, a bracket having two parallel members with a slot in between extends outwardly from the collar. On the distal ends of the two parallel members an arcuate member is attached between the two parallel members. The arcuate member curves inwardly towards the collar and has a concave surface with a plurality of teeth. The plurality of teeth on the gear wheel engage the plurality of teeth on the arcuate member and the motor controls the pivotal movement of the upper base portion in relation to the lower base portion.

In a third embodiment of the electronic adjustment mechanism, the pump and motor are the same as the first embodiment described above. The base is formed by an upper base portion and a lower base portion that are pivotably connected by a hinge or hinge assembly but a different electronic adjustment mechanism is used. In the third embodiment, the attachment plate extends outwardly from the motor and a sidewall extends downwardly. An electric motor, preferably a DC, AC, or brushless DC motor, more preferably a stepper motor, is attached to the outside of the member and the motor shaft passes through the sidewall. A gear wheel with a plurality of teeth is attached to the distal end of the motor shaft. A collar, as described above, is attached to the lower base portion. One side of the collar is attached to the upper base portion by the hinge. Opposite the hinge, a bracket having two parallel members with a slot in between extends outwardly from the collar. On the distal ends of the two parallel members an arcuate member is attached between the two parallel members. The arcuate member curves outwardly away from the collar and has a convex surface with a plurality of teeth. The plurality of teeth on the gear wheel engage the plurality of teeth on the arcuate member and the motor controls the pivotal movement of the upper base portion in relation to the lower base portion.

In a fourth embodiment of the electronic adjustment mechanism, the pump and motor are the same as the first embodiment described above. The base is formed by an upper base portion and a lower base portion that are pivotably connected by a hinge or hinge assembly but a different electronic adjustment mechanism is used. In the fourth embodiment, the attachment plate extends outwardly from the motor. A motor, preferably a DC, AC, or brushless DC motor, more preferably a stepper motor, is mounted on the attachment plate with the motor shaft extending downwardly through the plate towards the pump. A worm screw is attached to the distal end of the motor shaft. A collar, as described above, is attached to the lower base portion. One side of the collar is attached to the upper base portion by a hinge assembly. Opposite the hinge assembly, a bracket having two parallel members with a slot in between extends outwardly from the collar. On the distal ends of the two parallel members, an arcuate member is attached between the two parallel members. The arcuate member curves outwardly away from the collar and has a convex surface with a plurality of teeth. The plurality of teeth on the worm screw engage the plurality of teeth on the arcuate member and the motor controls the pivotal movement of the upper base portion in relation to the lower base portion.

Thus, the invention utilizes a linear actuator to allow electronic adjustment of the angle between the pump piston and the motor shaft. The linear actuator is mounted to the upper base portion and adjustably connected to the lower base portion. With this invention, the angle is adjustable electronically instead of manually.

By facing the piston flat to a port and varying the angle by means of the linear actuator, the pump can "syringe" fluid and dispense or aspirate at a near constant flow rate. When the linear actuator is extended, this will increase the angle between the portions of the base and the pump will aspirate through the active port. When the linear actuator is retracted, this will decrease the angle between the portions of the base and the pump will dispense through the active port.

With the ability to electronically adjust the angle, the angle can be manually or automatically adjusted to operate at one of several output volumes per revolution. For example, a large angle would be used for a high output volume per revolution for priming or flushing the fluid circuit. Then, the angle would be electronically adjusted to a small angle for a low output volume per revolution for small volume critical dispenses. With the ability to "syringe" fluid, a predictable and accurate aspirate and dispense volume can be achieved.

By varying the angle between the piston flat and the active port, varying barrel sizes can be achieved. This means that a single pump can be used to dispense fluids at rates equivalent to pumps with a large barrel size and pumps with a small barrel.

In still another aspect, this invention could be used like a traditional pump to prime the fluid circuit, and then operated like a syringe pump. This eliminates the need for two separate pumps and combines the syringe pump with the priming pump.

Features of the disclosure will become apparent from the following detailed description considered in conjunction with the accompanying drawings. It is to be understood, however, that the drawings are designed as an illustration only and not as a definition of the limits of this disclosure.

DETAILED DESCRIPTION

Figure 1:
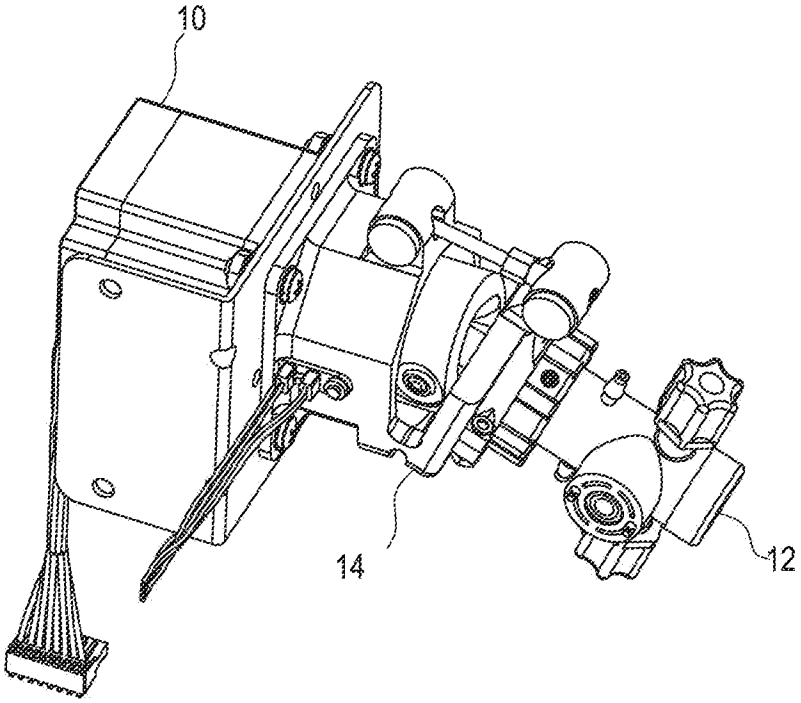
FIG. 1 (PRIOR ART)
FIG. 1 is a perspective view of a conventional motor/pump connection utilizing adjustable flow angle hardware, according to the prior art.

FIG. 1 shows a conventional prior art motor 10 connected to a pump 12 via a base 14. The motor 10 has a shaft that rotates about a rotational axis and the pump has a piston that also rotates about a rotational axis and also translates in the direction of the rotational axis. The shaft of the motor is coupled to the piston of the pump so that rotation of the motor shaft will cause rotation of the pump piston. Also, by tilting the rotational axis of the pump piston with respect to the rotational axis of the motor shaft, rotation of the motor shaft will also cause linear translation of the pump piston in a manner that is described in further detail below. A pump and motor support arrangement of this type is shown and described in commonly owned U.S. Pat. Nos. 4,941,809 and 5,020,980, the specifications of which are incorporated herein by reference in their entirety for all purposes.

FIG. 1 shows one prior art embodiment of an adjustable base 14, which includes a flange attached to the motor 10 and an opposing or mating flange attached to the pump 12. Between the two flanges is a flexible living hinge, which allows angular pivoting of the flanges with respect to the hinge. Opposite the hinge are two bosses, between which adjustable flow angle hardware is provided. In the embodiment shown in FIG. 1, the adjustable flow angle hardware is in the form of a screw and nut arrangement connected between pivot pins inserted in the respective bosses of the base. Rotation of the nut with respect to the screw selectively lengthens or shortens the length between the pivot pins of the bosses, thereby adjusting the angle of the motor flange with respect to the pump flange.

Figure 2:
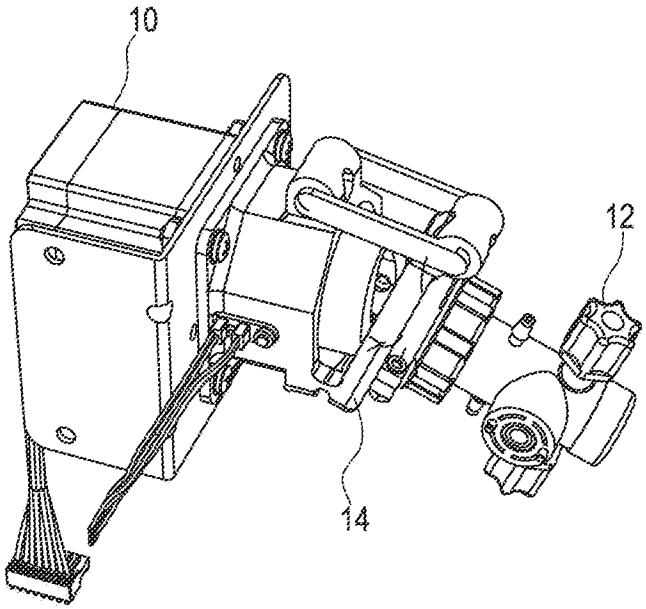
FIG. 2 (PRIOR ART)
FIG. 2 is a perspective view of a conventional motor/pump connection utilizing a fixed link, according to the prior art.

FIG. 2 shows an alternative embodiment of a prior art motor/pump connection of the prior art utilizing a base, similar to the base shown in FIG. 1, but utilizing a fixed link provided between the opposing bosses. Specifically, the base 14 shown in FIG. 2, again includes a motor mounting flange and a pump mounting flange on opposite sides of a flexible living hinge. Opposite the hinge are opposed bosses between which a fixed link is provided to set the angle between the pump and the motor. The length of the fixed link is selected based on the desired volumetric flow produced by the pump. In certain applications, a variety of fixed links of differing lengths can be provided to adjust the volume of the pump in a predetermined range.

Figure 3:
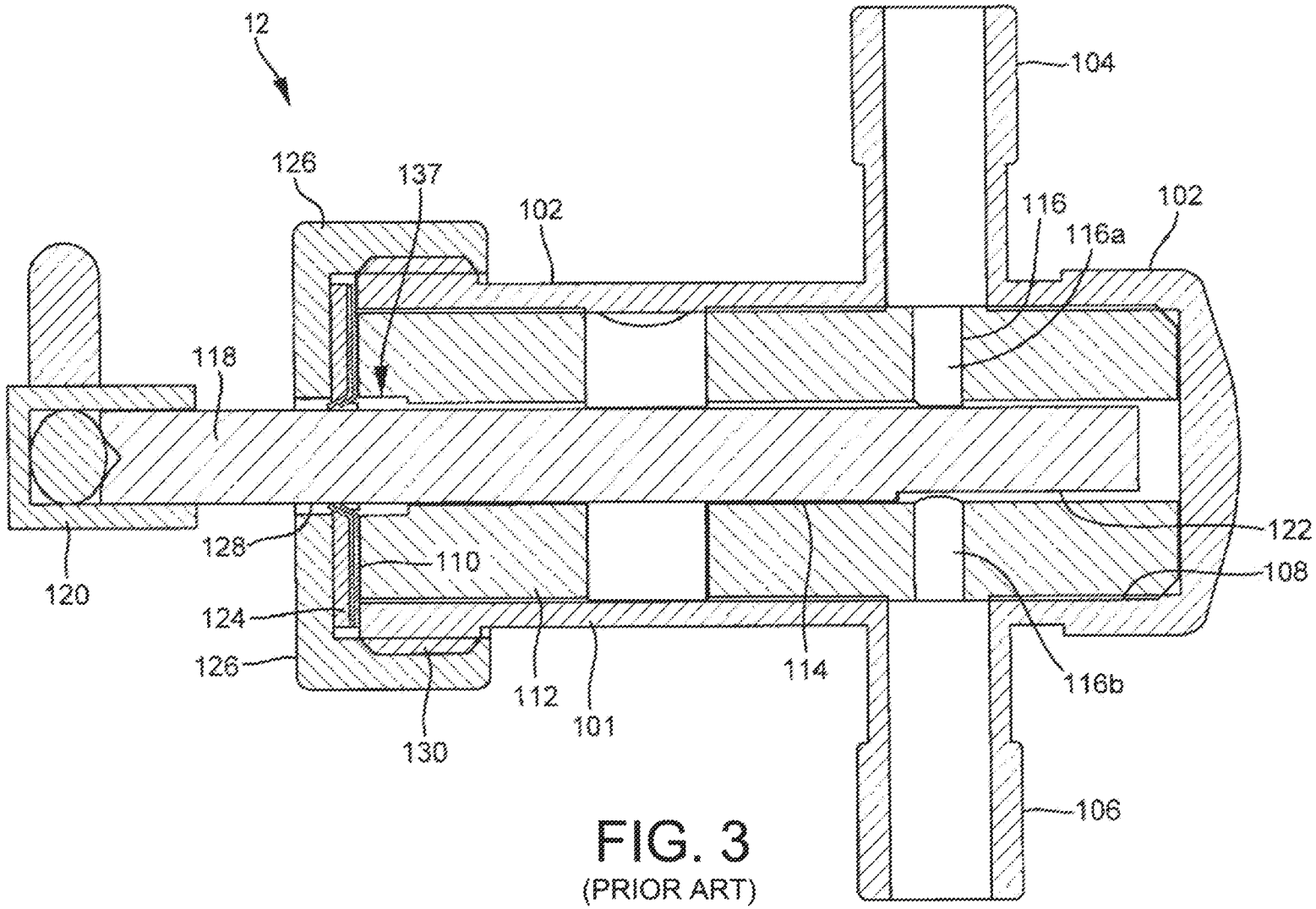
FIG. 3 (PRIOR ART)
FIG. 3 is a cross-sectional view of a liquid pump according to the prior art.

Referring now to FIG. 3, this prior art pump and motor arrangement operates as follows. The pump 12 generally includes a pump housing 101 and a piston 118. The pump housing 101 includes a plastic pump casing 102 having an inlet port 104 and an outlet port 106. The pump casing 102 defines a cylindrical chamber 108 having an open end 110. Received in the cylindrical chamber 108 is a ceramic piston liner 112 having a central longitudinal bore 114 and a transverse bore 116 communicating with the longitudinal bore 114. The transverse bore 116 includes a liner inlet port 116*a* fluidly communicating with the inlet port 104 of the pump casing 102 and a liner outlet port 116*b* fluidly communicating with the outlet port 106 of the pump casing so that a liquid can be pumped from the inlet port 116*a*, through the liner, to the outlet port 116*b* in a manner described below.

The pump piston 118 is axially and rotatably slidable within the central bore 114 of the piston liner 112. One end of the piston 118 extends out of the open end 110 of the pump casing 102 and includes a coupling 120 for engagement with the shaft of the motor 10. At its opposite end, the piston 118 is formed with a relieved or "cutout" portion 122 disposed adjacent the transverse bore 116 of the pump liner. As described below, the relieved portion 122 is designed to direct fluid into and out of the pump 12.

A seal assembly 124 is provided at the open end 110 of the pump casing 102 to seal the piston 118 and the pump chamber 108. The seal assembly 124 is retained at the open end 110 of the pump casing 102 by a gland nut 126 having a central opening 128 to receive the piston 118. The gland nut 126 is attached to the pump casing 102 with a threaded connection 130.

In operation, the motor 10 drives the piston 118 to axially translate and rotate within the central bore 114 of the piston liner 112. In order to draw liquid into the transverse bore 116 from the inlet port 104, the piston 118 is rotated as required to align the relieved portion 122 with the liner inlet port 116*a*. The piston 118 is then drawn back as required to take in the desired volume of liquid into the central bore 114 of the pump liner 112. Withdrawal of the piston 118 produces a negative pressure within the liner inlet port 116*a* of the transverse bore 116, which draws in liquid from the casing inlet port 104. The piston 118 is then rotated to align the relieved portion 122 with the liner outlet port 116*b*. Finally, the piston 118 is driven forward the required distance to force liquid into the outlet port 116*b* of the transverse bore 116 to produce the desired discharge flow.

Thus, each rotation of the motor shaft rotates the piston of the pump. Due to the angular orientation between the pump and the motor, each rotation of the motor shaft further causes the pump piston to reciprocate in the axial direction to alternately draw in and push out fluid to transfer fluid between an inlet and an outlet of the pump. The amplitude of the piston stroke determines the volume of the fluid delivered between the inlet and the outlet of the pump. By varying the angle of the pump with respect to the motor, the stroke of the piston is adjusted, thereby adjusting the volume of the fluid transferred between the inlet and the outlet.

In such prior art pump and motor arrangements, the angle of the pump 12 with respect to the motor 10 is adjustable via the base 14 to provide a desired volumetric flow of the pump with each rotation of the motor shaft. Therefore, it is desirable to provide a base 14 which is adapted for adjusting the angle between the axis of the pump and the motor shaft.

As used herein, a "stepper motor," also known as step motor or stepping motor, is an electric motor that divides a full shaft rotation into a number of steps of essentially uniform magnitude when driven from a sequentially switched DC power supply.

As used herein, the term "worm drive" is a gear arrangement in which a worm or worm screw meshes with an arcuate (i.e., curved) member with a plurality of teeth. The worm screw and arcuate member are arranged in parallel along their longitudinal axes and the threads of the worm screw engage the teeth of the arcuate member. Rotation of the worm screw in a clockwise direction causes the arcuate member to move in a first direction and rotation of the worm screw in a counterclockwise direction causes the arcuate member to move in the opposite direction.

As used herein, the terms "hinge," "hinge assembly," and "living hinge" refer to a movable joint or mechanism having one or more components, which connect(s) the upper base portion and lower base portion to change the angular relationship between their longitudinal axes.

As used herein, the term "living hinge" refers to a type of hinge made from an extension of the parent material (typically plastic). The living hinge "bridge" is the thin section of plastic that acts as a connection between two larger plastic sections, i.e., the upper base portion and the lower base portion. Preferably, the upper and lower base portions and the living hinge "bridge" will be made of one continuous piece of plastic. Since it is very thin and typically made from a flexible plastic, the living hinge is also able to rotate about one axis 180 degrees or more.

Figure 4:
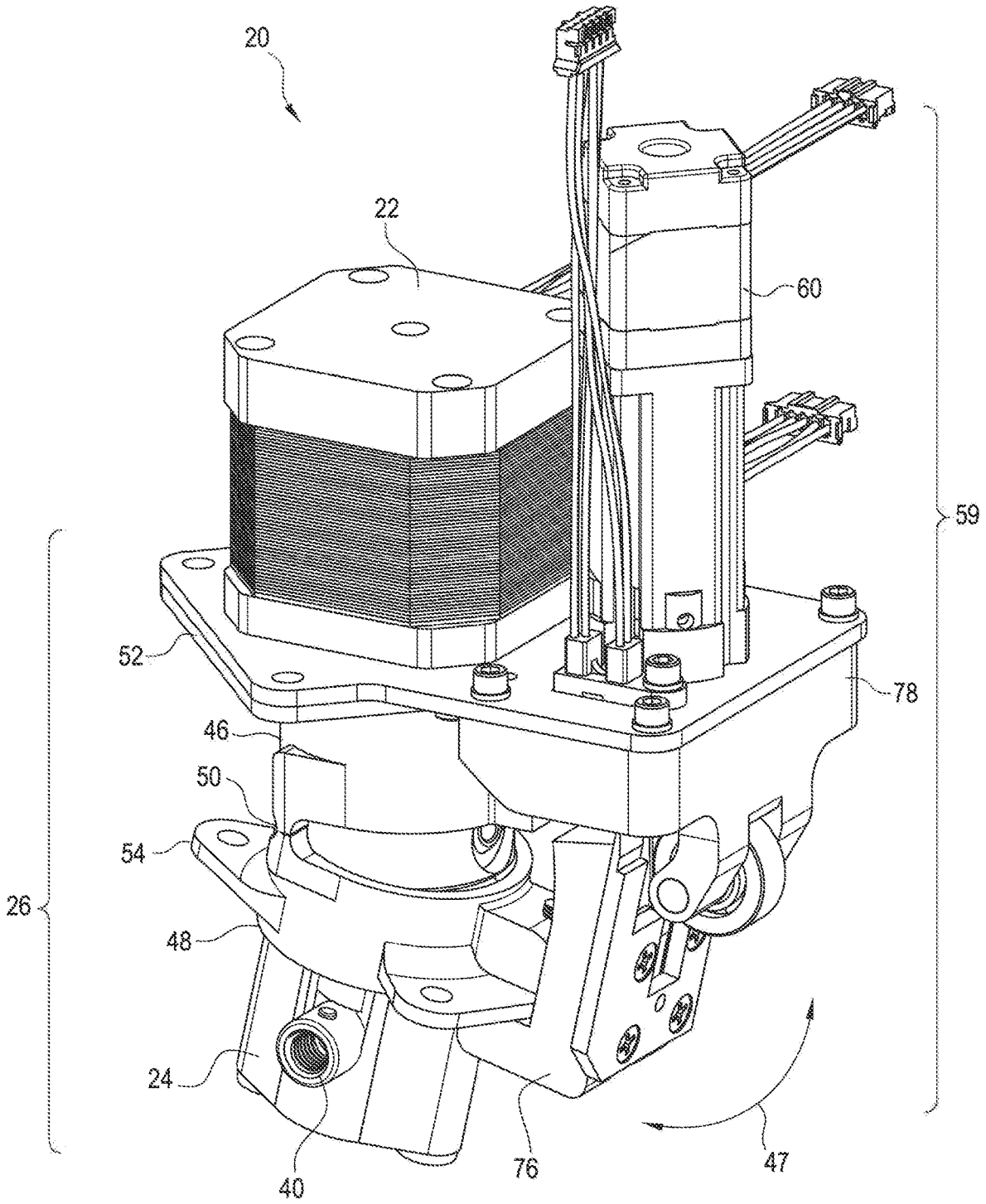
FIG. 4 is a perspective view of a motor/pump connection utilizing an electronic, angle adjustment mechanism according to a first embodiment of the present invention.
Figure 5:
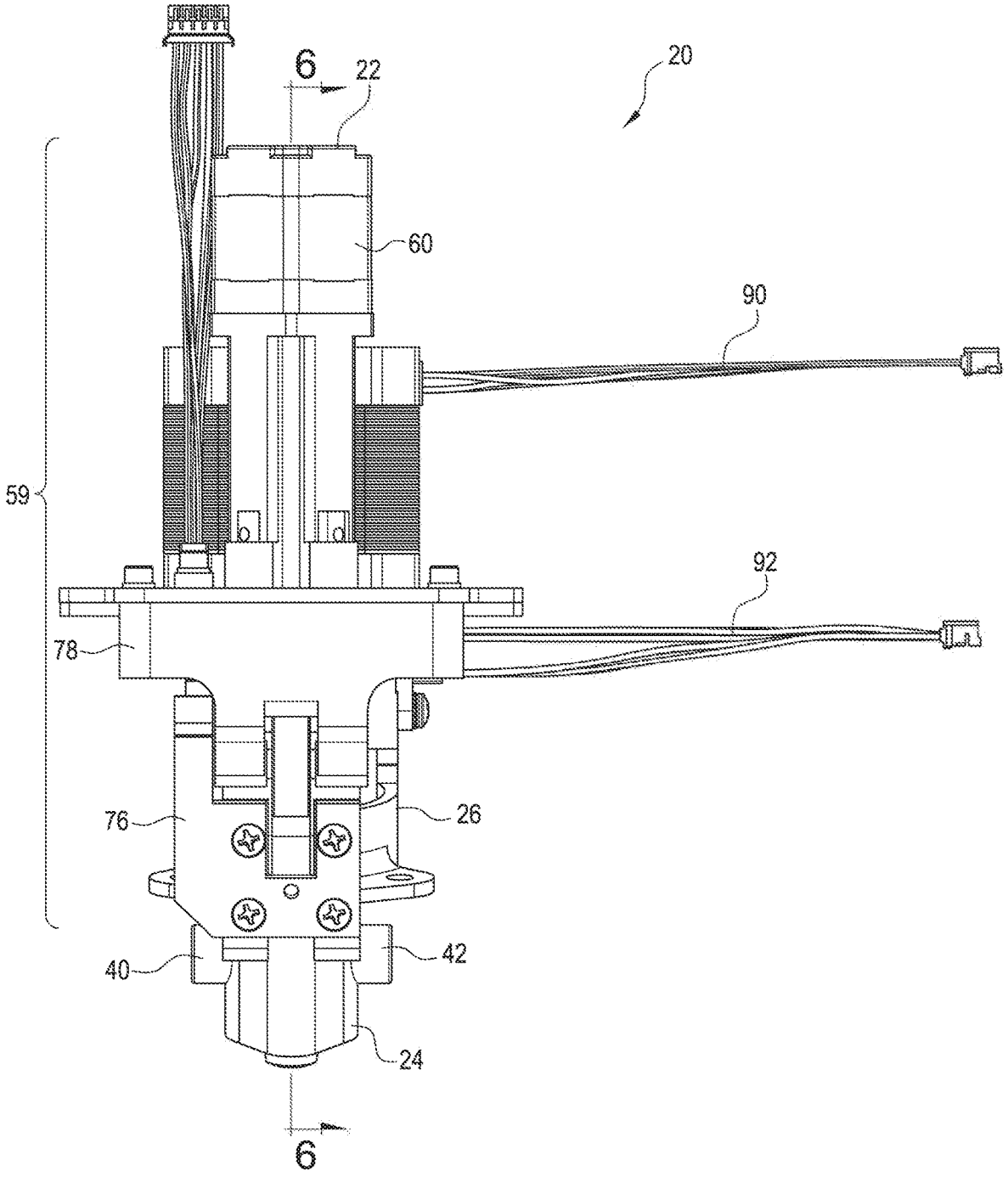
FIG. 5 is a front view of the motor/pump connection utilizing an electronic adjustment mechanism shown in FIG. 4.
Figure 6:
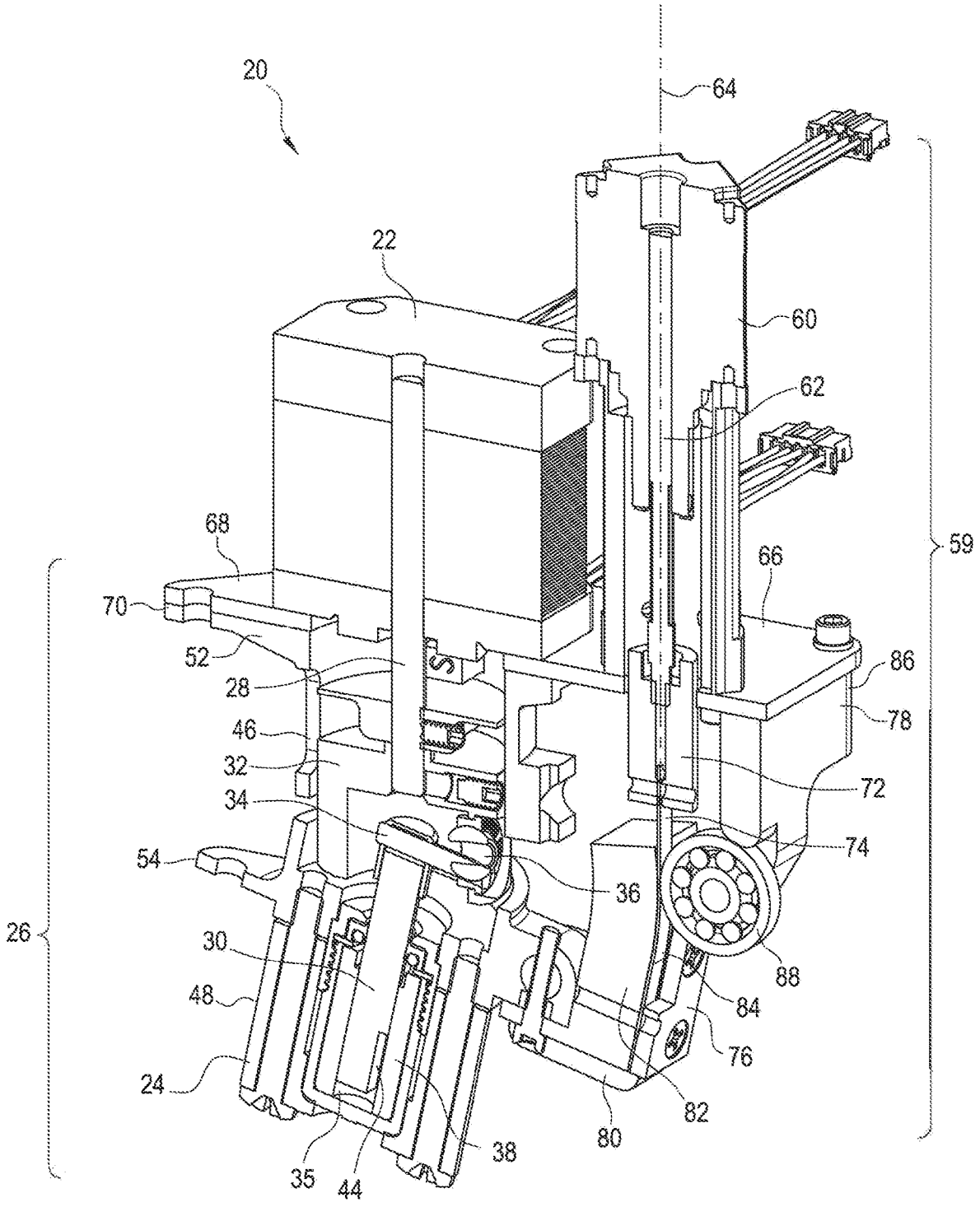
FIG. 6 is a cross-sectional view of the motor/pump connection utilizing an electronic adjustment mechanism taken along the line 6-6 in FIG. 5.

Referring now to FIGS. 4-6, an adjustable pump and motor assembly 20 with an angle adjustment actuator 60 according to a first embodiment of the present invention is shown. The adjustable pump and motor assembly 20 includes a conventional motor 22 connected to a fixed displacement pump 24 (as described above with reference to FIG. 3) via a base 26 with a pivotably connected upper base portion 46 and a lower base portion 48. The motor 22 has a shaft 28 that is connected to a spindle coupling 32 and the shaft 28 rotates the spindle coupling 32 about a rotational axis. The pump 24 has a piston 30 that also rotates about a rotational axis and also translates in the direction of its rotational axis. One end of the piston 30 is connected to the spindle coupling 32.

The shaft 28 of the motor 22 is coupled to the piston 30 of the pump 24 via the spindle coupling 32 so that rotation of the motor shaft 28 will cause rotation of the pump piston 30. Also, by tilting the rotational axis of the pump piston 30 with respect to the rotational axis of the motor shaft 28, rotation of the motor shaft 28 will also cause linear translation of the pump piston 30 and increase or decrease the volume of the chamber 35 at the distal end of the piston 30.

The end of the pump piston 30 closer to the motor shaft 28 is attached to a pin 34 that is perpendicular to the pump piston 30 and connected to a spherical bearing 36. The spherical bearing 36 is retained or captured in a hollow portion of the spindle coupling 32. When the spindle coupling 32 is rotated by the motor shaft 28, the spherical bearing 36 and pin 34 assembly translates the rotational movement of the spindle coupling 32 to the pump piston 30. Rotation of the spindle coupling 32 rotates and reciprocates the pump piston 30 inside the cylinder 38 of the pump 24 in a linear direction along the axis of the pump piston 30. As the pump piston 30 moves linearly, the spherical bearing 36 rotates in the hollow of the spindle coupling 32. The reciprocal rotation of the pump piston 30 over a 180-degree arc switches the piston flat 44 between a first position facing the first port 40 and a second position facing the second port 42. In the first position, the piston flat 44 allows fluid to flow from the first port 40 into the chamber 35. As the pump piston 30 rotates 180-degrees, the first port 40 is closed off and the piston flat 44 moves to the second position and dispenses the fluid from the chamber 35 through the second port 42. As the pump piston 30 reciprocally rotates in the cylinder 38 between opposing ports 40, 42, the piston flat 44 is open to only one port 40, 42 at a time.

The port 40, 42 that is open to the piston flat 44 is considered the active port. The reciprocating motion pulls fluid in from and pushes fluid out of the active port. The reciprocation and rotation is timed to pull fluid in from one port and push fluid out of the opposite port. Preferably, the piston flat 44 reciprocates by rotating about 180 degrees between the ports 40, 42. Modifying the angle that the pump piston 30 is held relative to the motor shaft 28 adjusts the volume in the chamber 35 at the bottom of the pump piston 30 so that the output volume per revolution can be calibrated to a desired output volume.

As also discussed above, the angle between the axis of the pump piston 30 and the motor shaft 28 is determined by means of the base 26 having an upper base portion 46 and a lower base portion 48 pivotably connected to one another via a hinge 50. The upper base portion 46 has a flange 52 that attaches to the motor 22, and the lower base portion 48 has a flange 54 that holds the pump head 24 that houses the piston 30 and cylinder 38. The hinge 50 allows the upper base portion 46 to be tilted relative to the lower base portion 48 in a direction indicated by arrow 47 in FIG. 4. Typically, the base 26, including the upper base portion 46 and lower base portion 48, are injection molded together with a living hinge 50. However, it is within the scope of the invention for these portions to be molded separately with a pinned hinge instead.

The piston 30 extends into the cylinder 38 and forms a chamber 35 between the distal end of the piston 30 and the bottom of the cylinder 38. The volume of the chamber 35 changes as the piston 30 travels up and down in the cylinder 38. Adjusting the angle between the axis of the pump piston 30 and the motor shaft 28 adjusts the travel distance of the piston 30 and determines the maximum volume of the chamber 35 and the flow rate.

Adjustment of the angle between the motor shaft 28 and the pump piston 30 is achieved with an electronic adjustment mechanism 59 according to a first embodiment of the present invention shown in FIGS. 4-6. The electronic adjustment mechanism 59 includes a linear actuator 60 attached to one of the flanges of the base 26. FIGS. 4-6 are directed to a first embodiment of the present invention, wherein a linear actuator 60 attached to the motor flange 52 of the upper base portion 46. However, it is conceivable for the actuator 60 to be attached to the opposite pump flange 54, wherein the arrangement of the remaining associated components described herein would be reversed.

The linear actuator 60 is preferably an electronic device capable of translating a linear actuator drive rod 62 in precise increments along a linear axis 64 extending parallel to the rotational axis of the motor shaft 28. One type of linear actuator for use in the present invention is known in the art as a captive nut linear actuator.

The motor flange 52 on the upper base portion 46 is preferably attached to the motor 22 by an attachment plate 66. The attachment plate 66 extends outwardly from the motor 22 and is sized and shaped to allow mounting of the linear actuator 60 of the electronic angle adjustment mechanism 59 to an upper surface 68 of the attachment plate 66. The mounting of the linear actuator 60 and the motor 22 on the upper surface 68 of the attachment plate 66 and mounting of the motor flange 52 on a lower surface 70 of the attachment plate 66 can be accomplished with conventional fasteners, such as bolts with threaded connections in respective components. Preferably, the attachment plate 66 extends outwardly from the motor 22 and is formed from a single sheet of metal and shaped to accommodate the electronic angle adjustment mechanism 59.

Attached to a distal end of the linear actuator drive rod 62 of the linear actuator 60 is a drive rod coupler 72. The drive rod coupler 72 extends outwardly from the linear actuator 60 in the axial direction along the longitudinal axis 64. The drive rod coupler 72 further extends axially through an opening provided in the attachment plate 66 between the upper and lower surfaces. Attached to a distal end of the drive rod coupler 72, opposite the drive rod 62 is a flexible member 74.

The flexible member 74 is preferably made from a material having the strength to transfer the linear force imparted by the drive rod 62 along its longitudinal axis 64, yet flexible enough to allow for some slight bending, as will be discussed further below. A suitable material for the flexible member, for example, is spring steel.

The flexible member 74 has a first end attached to the distal end of the drive rod coupler and a second end, opposite the first end, connected to the lower flange 54 of the base 26. Thus, linear motion of the linear actuator drive rod 62 will cause linear motion of the flexible member 74 in the same direction. Because the linear actuator 60 is connected to the upper base portion 46 and the flexible member 74 is connected to the lower base portion 48, linear motion of the flexible member 74 will cause the lower base portion 48 to pivot with respect to the upper base portion 26 about the hinge 50.

The flexible member 74 initially extends from the drive rod coupler 72 in a direction along the linear axis 64 of the linear actuator drive rod 62. However, the flexible member 74 is permitted to begin to bend at a point along the longitudinal axis 64 beyond the drive rod coupler 72. Such bending of the flexible member 74 is desirable to compensate for the arc shaped path of travel of the end of the lower flange 54 opposite the base hinge 50.

The bending of the flexible member 74 can be facilitated by a cam block assembly 76 and a roller bearing assembly 78. The cam block assembly 76 includes a bracket 80 mounted to the lower flange 54 of the base 26 opposite the base hinge 50. Any attachment means can be used. For example, a conventional screw fastener engaged in a threaded hole formed in the lower flange 54 will be sufficient.

The cam block assembly 76 further includes a cam block 82 supported by the bracket 80. The cam block 82 has a curved support surface 84 facing the flexible member 74. The curved support surface 84 of the cam block 82 has a radius of curvature about the pivot point of the base hinge 50 defined by the distance from the pivot point to the intersection point of the flexible member 74 with the lower flange 54 of the base 26. With the flexible member 74 bearing against the curved support surface 84 of the cam block 82, the flexible member 74 will traverse a curved path coinciding with the path of the distal end of the lower flange 54 about the base hinge 50.

The roller bearing assembly 78 includes a bracket 86 mounted to the attachment plate 66. The bracket 86 rotatably supports a roller bearing 88 positioned opposite the cam surface 84 of the cam block 82. In this regard, the roller bearing 88 can be rotatably mounted on a pin fixed to the roller bearing assembly bracket 86. The roller bearing 88 here is used to help constrain the flexible member 74 against the curved support surface 84. One or more springs (not shown) could also be included with the roller bearing assembly 78 to provide an ongoing bias on the roller bearing 88 for pressing the flexible member 74 against the cam block 82. Without the roller bearing 88, the flexible member 74 would only be constrained by the drive rod 62 and would therefore, be susceptible to bending outwardly.

As can be appreciated from the description above, at least some embodiments of the present invention include a controller that is coupled to the motor 22 and the linear actuator 60 via respective electrical lines 90, 92. One such example of a controller is a computer device that enables dynamic control of the linear actuator 60 and causes the electronic adjustment mechanism 59 to be precisely and repeatably modified. As such, the volume of fluid dispensed is extremely accurate, repeatable, and dynamic. One skilled in the art will appreciate that the invention may be practiced by one or more computing devices and in a variety of system configurations, including in a networked configuration.

Figure 7:
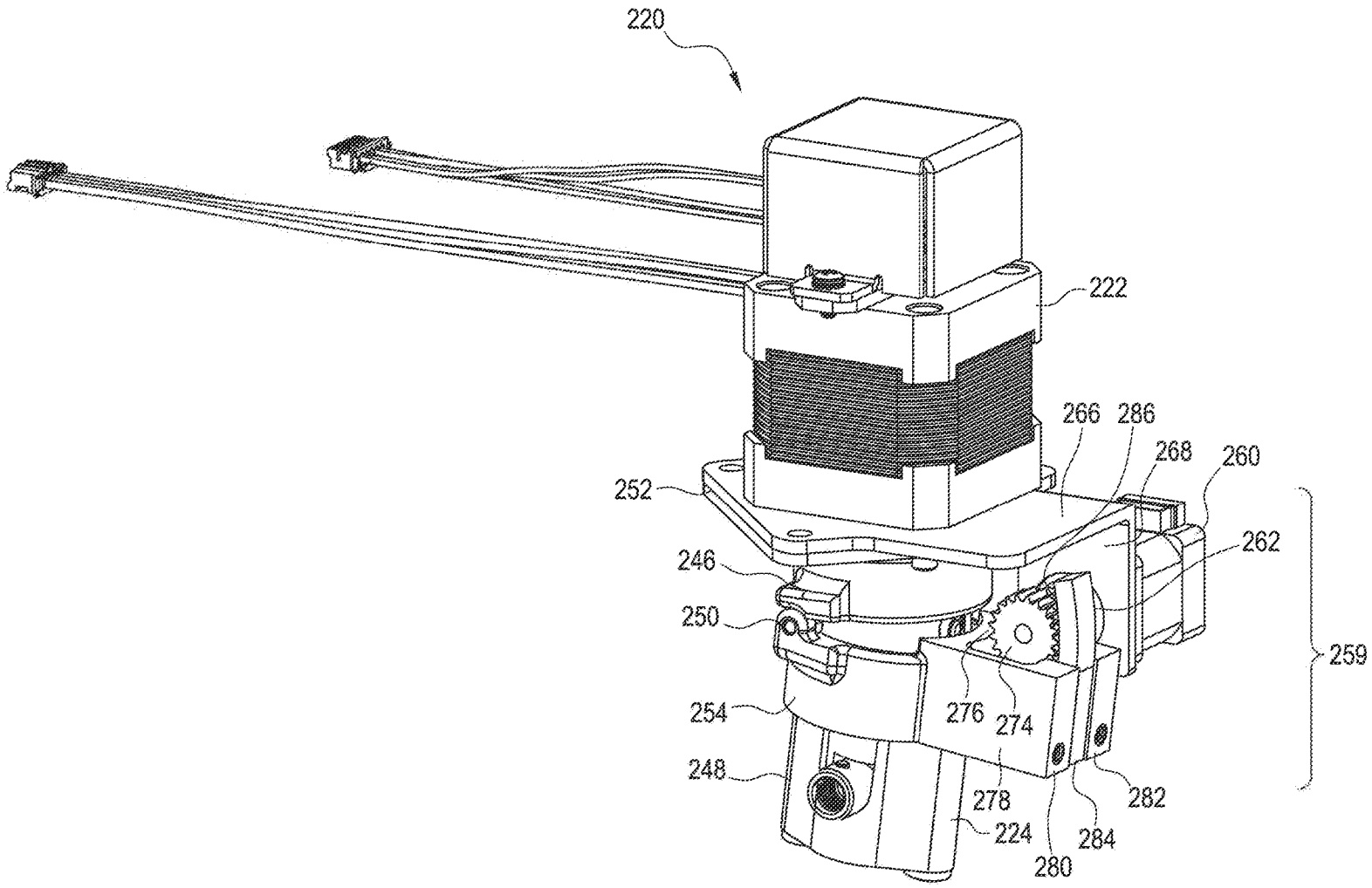
FIG. 7 is a perspective view of a motor/pump connection utilizing an internal gear, electronic angle adjustment mechanism according to a second embodiment of the present invention.

A second embodiment of the electronic adjustment mechanism 259 of the present invention is shown in FIG. 7. The attachment plate 266 is mounted between the motor 222 and a motor flange 252 on an upper base portion 226 and extends outwardly on one side of the motor 222. The upper base portion 246 and a lower base portion 248 connected to the pump 224 are pivotably connected by a hinge 250. A sidewall 268 on one side of the attachment plate 266 extends downwardly from the motor 222 towards the pump 224. An electric motor 260 is attached to the outside of the sidewall 268 and the motor shaft 262 passes through the sidewall 268. A gear wheel 274 with a plurality of teeth 276 is attached to the distal end of the motor shaft 262

A collar 254 is attached to the lower base portion 248 and one side of the collar 254 is attached to the upper base portion 246 by the hinge 250. Opposite the hinge 250, a bracket 278 having two parallel members 280, 282 extends outwardly from the collar 254. On the distal end of the two parallel members 280, 282, an arcuate member 284 is attached between the two parallel members 280, 282. The arcuate member 284 curves inwardly towards the collar 254 and has a plurality of teeth 286 on the concave, inward surface. The plurality of teeth 276 on the gear wheel 274 engage the plurality of teeth 286 on the arcuate member 284 and the motor 260 controls the pivotal movement of the upper base portion 246 in relation to the lower base portion 248.

Figure 8:
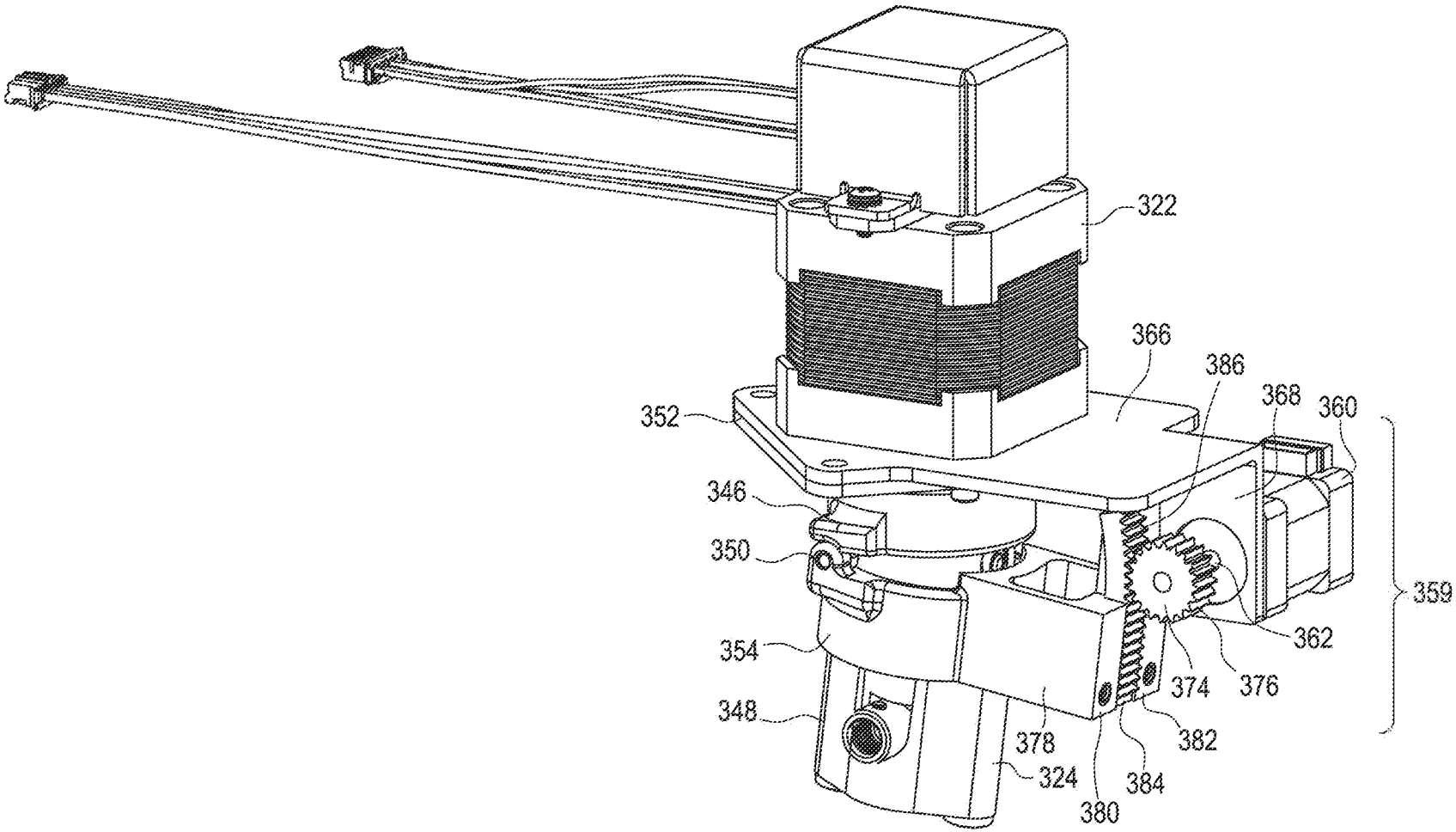
FIG. 8 is a perspective view of a motor/pump connection utilizing an external gear, electronic angle adjustment mechanism according to a third embodiment of the present invention.

A third embodiment of the electronic adjustment mechanism 359 of the present invention is shown in FIG. 8. The attachment plate 366 is mounted between the motor 322 and a motor flange 352 on an upper base portion 346 and extends outwardly on one side of the motor 322. The upper base portion 346 and a lower base portion 348 connected to the pump 324 are pivotably connected by a hinge 350. A sidewall 368 on one side of the attachment plate 366 extends downwardly from the motor 322 towards the pump 324. An electric motor 360 is attached to the outside of the sidewall 368 and the motor shaft 362 passes through the sidewall 368. A gear wheel 374 with a plurality of teeth 376 is attached to the distal end of the motor shaft 362.

A collar 354 is attached to the lower base portion 348 and one side of the collar 354 is attached to the upper base portion 346 by the hinge 350. Opposite the hinge 350, a bracket 378 having two parallel members 380, 382 extends outwardly from the collar 354. On the distal end of the two parallel members 380, 382, an arcuate member 384 is attached between the two parallel members 380, 382. The arcuate member 384 curves outwardly away from the collar 354 and has a plurality of teeth 386 on the convex, outward surface. The plurality of teeth 376 on the gear wheel 374 engage the plurality of teeth 386 on the arcuate member 384 and the motor 360 controls the pivotal movement of the upper base portion 346 in relation to the lower base portion 348.

Figure 9:
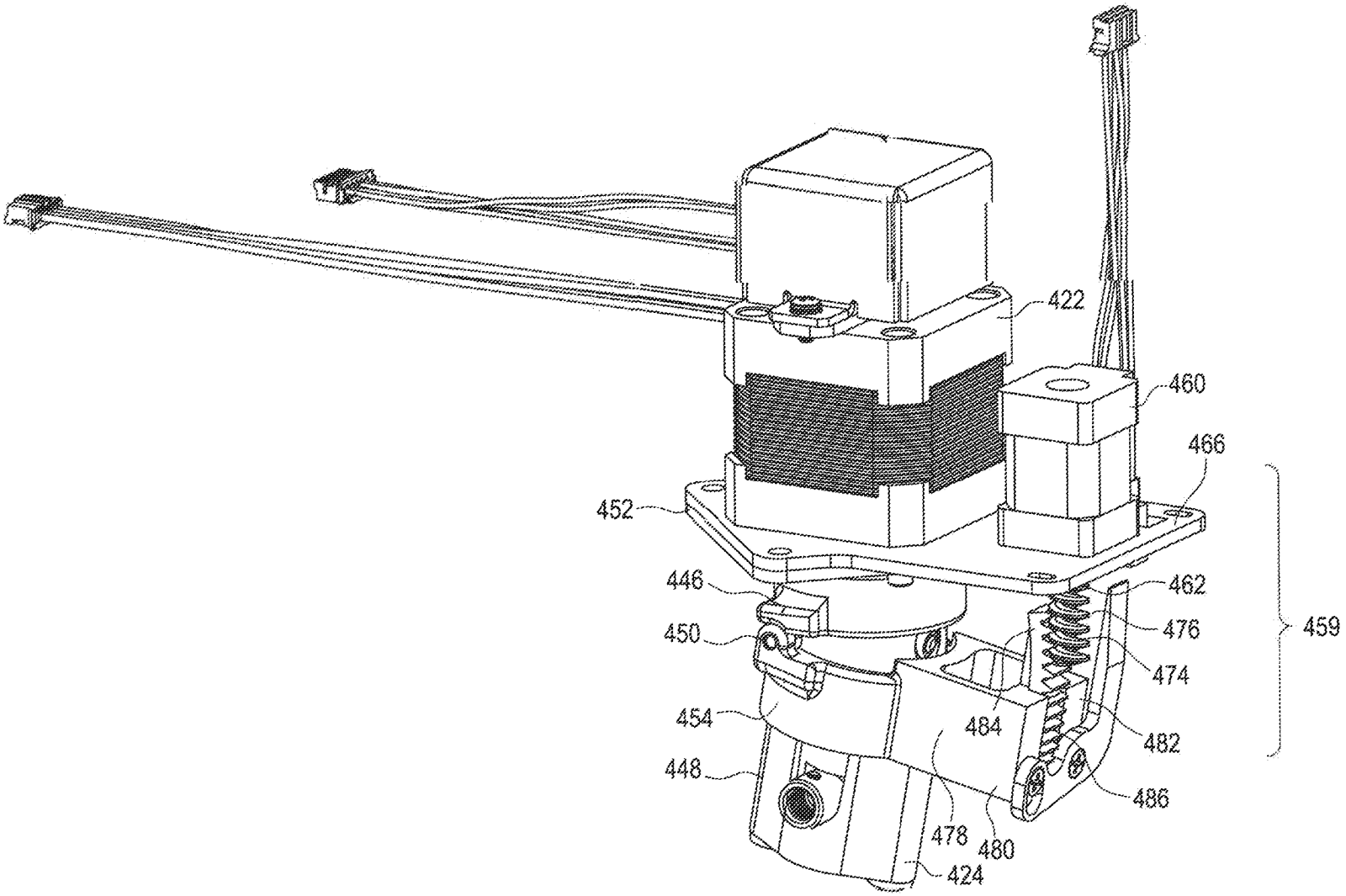
FIG. 9 is a perspective view of a motor/pump connection utilizing a worm screw, electronic angle adjustment mechanism according to a fourth embodiment of the present invention.

A fourth embodiment of the electronic adjustment mechanism 459 of the present invention is shown in FIG. 9. The attachment plate 466 is mounted between the motor 422 and a motor flange 452 on an upper base portion 446 and extends outwardly on one side of the motor 422. The upper base portion 446 and a lower base portion 448 are pivotably connected by a hinge 450. A motor 460 is mounted on the attachment plate 466 with the motor shaft 462 extending downwardly through the plate 466 towards the pump 424. A worm screw 474 with a continuous spiral thread 476 is attached to the distal end of the motor shaft 462.

A collar 454 is attached to the lower base portion 448 and one side of the collar 454 is attached to the upper base portion 446 by a hinge 450. Opposite the hinge 450, a bracket 478 having two parallel members 480, 482 extends outwardly from the collar 454. On the distal end of the two parallel members 480, 482, an arcuate member 484 is attached between the two parallel members 480, 482. The arcuate member 484 curves outwardly away from the collar 454 and has a plurality of teeth 486 on the convex, outward surface. The continuous spiral thread 476 on the worm screw 474 engages the plurality of teeth 486 on the arcuate member 484 and the motor 460 controls the pivotal movement of the upper base portion 446 in relation to the lower base portion 448.

Embodiments of the present invention embrace one or more computer readable media, wherein each medium may be configured to include or includes thereon data or computer executable instructions for manipulating data. The computer executable instructions include data structures, objects, programs, routines, or other program modules that may be accessed by a processing system, such as one associated with a general-purpose computer capable of performing various different functions or one associated with a special-purpose computer capable of performing a limited number of functions. Computer executable instructions cause the processing system to perform a particular function or group of functions and are examples of program code means for implementing steps for methods disclosed herein. Furthermore, a particular sequence of the executable instructions provides an example of corresponding acts that may be used to implement such steps. Examples of computer readable media include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing system.

For example, the computer device may be a personal computer, a notebook computer, a personal digital assistant ("PDA") or other hand-held device, a workstation, a mini-computer, a mainframe, a supercomputer, a multi-processor system, a network computer, a controller, a processor-based consumer electronic device, or the like.

As a result of the present invention, a mechanism for remote adjustment of the output volume per revolution of a fixed displacement pump is provided. By extending the linear actuator, the angle and output volume per revolution of the pump is increased. By retracting the linear actuator, the angle and output volume per revolution of the pump is decreased.

Moreover, by using a flexible member instead of a rigid member to link between the linear actuator and the upper base portion, a proportional relationship is established between the linear motion of the linear actuator and the angular motion of the upper base portion relative to the lower base portion. Also, the ability for electronic adjustment of flow allows the fixed displacement pump to utilize a large output volume per revolution to prime the lines, and then switch to a low output volume per revolution for the required small volume dispenses without manual intervention.

The present invention further overcome issues of varying aspirate volumes relative to dispense volumes in a fixed displacement pump. Traditionally, these pumps have only been used to move fluid by rotation of the main motor. With the ability to electronically adjust the angle of the base, a new method to move fluid with a syringing motion becomes possible. With the piston flat open to one port, extending the linear actuator increases the angle of the base and pulls fluid into the pump head. In contrast, by retracting the linear actuator, the angle of the base decreases and pushes fluid out of the pump head. Furthermore, due to the flexible member, the linear motion has a proportional relation to the angular motion, which in turn has a proportional relation to the output volume. This extension and retraction gives a predictable aspirate and dispense volume from the active port.

In addition, by introducing the electronic adjustment of the angle for the syringing function in valve-less pumps, it is possible to adjust the barrel size by varying the angle of the piston flat relative to the active port.

Also, with the ability to both operate as a traditional syringe pump and a traditional fixed displacement pump, the variable displacement pump can prime the lines by operating like a traditional fixed displacement pump and give constant flow rate dispenses by operating like a traditional syringe pump.

While various embodiments of the present invention are specifically illustrated and/or described herein, it will be appreciated that modifications and variations of the present invention may be effected by those skilled in the art without departing from the spirit and intended scope of the invention.

We claim:

1. An angle adjustment mechanism for a pump and a motor comprising: a base including an upper base portion having a first end for mounting the motor and a second end, a lower base portion having a first end for mounting the pump and a second end, and a hinge pivotably connecting said second end of said upper base portion and said second end of said lower base portion; a linear actuator; a substantially flat flexible member having a proximal end attached to said linear actuator and a distal end connected to a collar attached to the lower base portion; a cam block mounted to said collar, said cam block having a curved support surface that forms a curved path for guiding said substantially flat flexible member along said curved path; a roller bearing adjacent said cam block, said roller bearing pressing said substantially flat flexible member against said curved surface of said cam block; and an attachment plate that attaches the motor to the first end of the upper base portion, said attachment plate extending outwardly from the motor for mounting the linear actuator; wherein actuation of said linear actuator drives the substantially flat flexible member in the curved path causing said lower base portion and upper base portion to pivot with respect to each other about said hinge, thereby changing an angle between said lower base portion and said upper base portion.

2. The angle adjustment mechanism as defined in claim 1, wherein said linear actuator comprises a drive rod movable along a linear axis and a drive rod coupler attached to a distal end of said drive rod, said substantially flat flexible member being attached to said drive rod coupler.

3. The angle adjustment mechanism as defined in claim 1, wherein said substantially flat flexible member comprises a spring steel material.

4. The angle adjustment mechanism as defined in claim 1, wherein said upper base portion comprises a flange and said flange attaches the upper base portion to the attachment plate.

5. The angle adjustment mechanism as defined in claim 1, wherein said substantially flat flexible member is bendable for transitioning a linear motion of said linear actuator to a pivoting motion of said upper base portion and said lower base portion with respect to one another.

6. An angle adjustment mechanism for a pump and a motor comprising:

a base including an upper base portion having a first end for mounting the motor and a second end, a lower base portion having a first end for mounting the pump and a second end, and a hinge pivotably connecting said second end of said upper base portion and said second end of said lower base portion, wherein a collar is attached to the lower base portion;

a linear actuator;

an attachment plate that attaches the motor to the first end of the upper base portion, said attachment plate extending outwardly from the motor for mounting the linear actuator;

a cam block mounted to said collar, said cam block having a curved support surface that forms a curved path for guiding a substantially flat flexible member along said curved path;

a roller bearing adjacent said cam block, said roller bearing pressing the substantially flat flexible member against said curved surface of said cam block; and wherein actuation of said linear actuator drives the substantially flat flexible member in said curved path causing said lower base portion and upper base portion to pivot with respect to each other about said hinge, thereby changing an angle between said lower base portion and said upper base portion.

7. The angle adjustment mechanism as defined in claim 6, wherein said linear actuator comprises a drive rod movable along a linear axis and a drive rod coupler attached to a distal end of said drive rod, said substantially flat flexible member being attached to said drive rod coupler.

8. The angle adjustment mechanism as defined in claim 6, wherein said substantially flat flexible member comprises a spring steel material.

9. The angle adjustment mechanism as defined in claim 6, wherein said upper base portion comprises a flange and said flange attaches the upper base portion to the attachment plate.

10. The angle adjustment mechanism as defined in claim 6, wherein said substantially flat flexible member is bendable for transitioning a linear motion of said linear actuator to a pivoting motion of said upper base portion and said lower base portion with respect to one another.

* * * * *